United States Patent [19]

Wolske

[11] 4,207,983

[45] Jun. 17, 1980

[54] PACKETING NET BAGS

[75] Inventor: Eugene H. Wolske, Minnetonka, Minn.

[73] Assignee: Bemis Company, Inc., Minneapolis, Minn.

[21] Appl. No.: 860,290

[22] Filed: Dec. 14, 1977

[51] Int. Cl.[2] ..... B65D 33/00

[52] U.S. Cl. ..... 206/554; 206/526; 229/53

[58] Field of Search ..... 53/571, 572, 573, 384, 53/385, 386; 206/554, 526, 451, 806; 229/55, 53; 150/1, 3

[56] References Cited

U.S. PATENT DOCUMENTS

| | | | |
|---|---|---|---|
| 1,872,640 | 8/1932 | Pink | 229/53 |
| 3,161,212 | 12/1964 | White | 53/572 |
| 3,338,398 | 8/1967 | Altman, Jr. | 206/554 X |
| 3,360,183 | 12/1967 | Stahl | 229/55 |
| 4,000,768 | 1/1977 | Siegel | 150/3 |
| 4,098,405 | 7/1978 | Botrin | 229/62 |
| 4,099,666 | 7/1978 | Welles | 229/62 |

FOREIGN PATENT DOCUMENTS

| | | | |
|---|---|---|---|
| 651519 | 10/1962 | Canada | 150/1 |

*Primary Examiner*—Stephen P. Garbe

*Attorney, Agent, or Firm*—Senniger, Powers, Leavitt and Roedel

[57] ABSTRACT

A net bag having strips of film secured to opposite walls thereof at its mouth, one strip constituting a wicketing flap, the other enabling automatic opening of the bag, a stack of such bags held together in the stack by a wicket having its legs extending through the wicketing flaps of the bags, and a method of making the bags.

28 Claims, 9 Drawing Figures

PACKETING NET BAGS

BACKGROUND OF THE INVENTION

This invention relates to the packeting of net bags, more particularly to a net bag constructed for stacking a plurality of the bags and holding the bags in assembly in the stack with fastening means such as a wicket.

This invention is especially concerned with packeting net bags, e.g., bags comprising a flat bag tube of net material having a bottom end closure comprising a length of tape folded around one end of the bag tube (constituting the bottom end of the bag) and secured to the tube. Reference may be made to Dickmann U.S. Pat. No. 3,424,113 showing apparatus for applying such bottom end closures to open-mesh bag tubes. The packeting is of a type referred to as a wicket pack, in which a stack of bags is held in assembly by means of a U-shaped wire member or "wicket", with each successive bag adapted to be opened at its mouth for filling; and then separated from the stack. Reference may be made to such U.S. Pat. Nos. as 3,312,339, 3,329,260, 3,338,398 and 3,777,930 showing wicketed packets of bags made of sheet plastic material (e.g., polyethylene film) as distinguished from net, and U.S. Pat. No. 3,198,325 showing a packet of bags made of sheet plastic material with fastening means equivalent to a wicket. Unlike sheet plastic material (e.g., polyethylene film) used for bags, net material used for bags (e.g., knitted net material knit from narrow ribbons of polyethylene film) cannot be readily torn like film, and this has heretofore precluded packeting net bags in wicket-type packs.

The invention involves an improvement on the net bag with a wicketing flap shown in the copending coassigned U.S patent application of James R. Stricker, Ser. No. 825,984, filed Aug. 19, 1977 now abandoned. That application shows a bag made of net material knitted from strands constituted by narrow ribbons of high-density polyethylene film having opposed walls, closed at its bottom and open at its mouth edge, and having a flap comprising a strip of polyethylene film sealed to one of the walls of the bag, said strip having a portion projecting beyond the mouth edge of said one wall, and said projecting portion having a pair of holes therein for receiving the legs of a wicket.

SUMMARY OF THE INVENTION

Among the several objects of the invention may be noted the provision of a net bag, e.g., a bag comprising a flat tube of knitted net material closed at the bottom and having an open mouth, with improved means whereby a plurality of the bags may be held together in a stack with each bag adapted to be opened at its mouth in an automatic filling apparatus (wherein each bag is automatically opened, as distinguished from being manually opened) for filling the bag, each bag after having been filled then being readily separated from the stack; the provision of a net bag with such means whereby the bags may be held together in stacked assembly by a wicket; the provision of a stack of such bags held together with each bag adapted automatically to be opened at its mouth for filling and then readily separated from the stack.

In general, a bag of this invention is characterized in being made of net material, having opposed walls, being closed at its bottom and open at its mouth end, each wall having a mouth edge, one of the walls having a flap extending beyond its mouth edge and beyond the mouth edge of the other wall, the flap comprising a piece of sheet material secured to said one wall of the bag and having a portion projecting beyond the mouth edge of said one wall, said projecting portion being adapted to receive means for holding a plurality of the bags in stacked assembly, the flap of each bag being adapted to be torn off said means for tearing each bag off said means. The wall with the flap may be referred to as the back wall of the bag, and the other wall may be referred to as the front wall. The bag further has a second piece of material secured to the front wall at its mouth edge. The projecting portion of said flap projects beyond the edge of said second piece of sheet material at the mouth of the bag.

In a stack of bags according to the invention, the bags are stacked with the back wall of each bag against the front wall of the next bag, and fastening means is provided extending through the projecting portions of the flap holding the bags together in the stack, the flap of each bag being adapted to be torn off the fastening means for tearing each successive bag off the fastening means.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
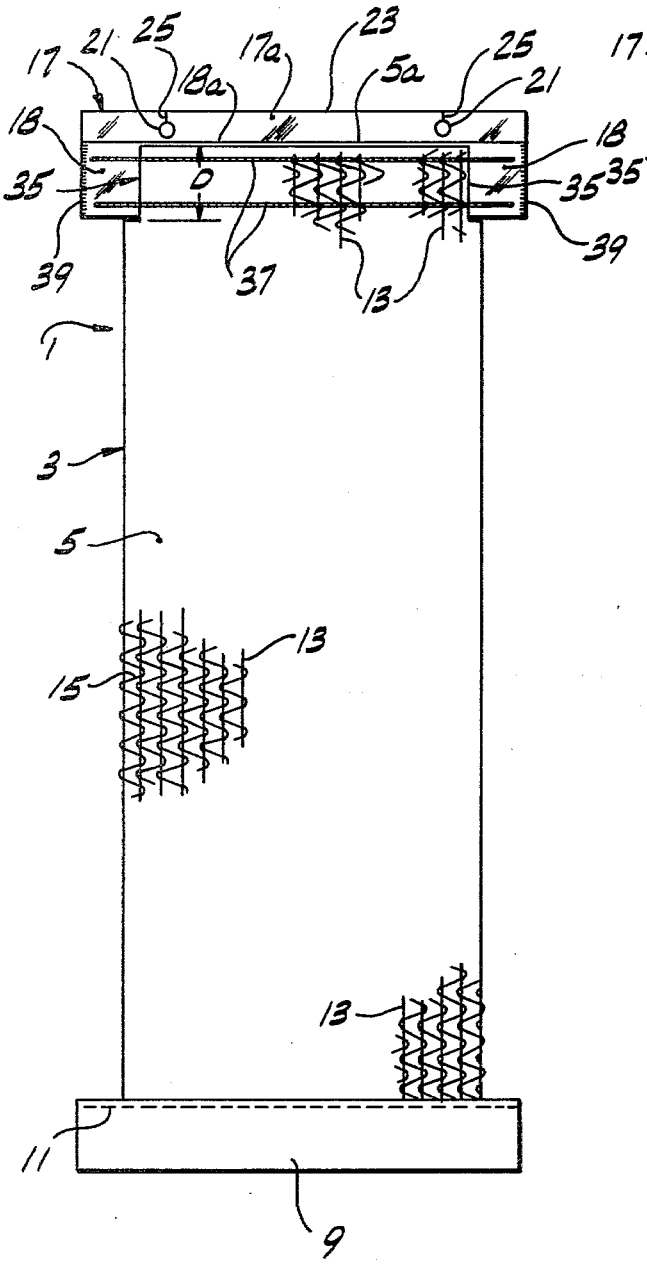
FIG. 1 is a front elevation of a bag of this invention.

Referring to the drawings, a bag of this invention, indicated in its entirety by the reference numeral 1, is shown to comprise a flat tube 3 of net material having opposed walls 5 and 7, closed at one end constituting its bottom end by a length of paper tape 9 folded around the bottom end of the tube and secured to the tube by stitching as indicated at 11. The tube is open at its other end, i.e., at its mouth end, where the end edges of the walls 5 and 7 are designated *5a* and *7a*, these edges being flush one with the other.

Figure 2:
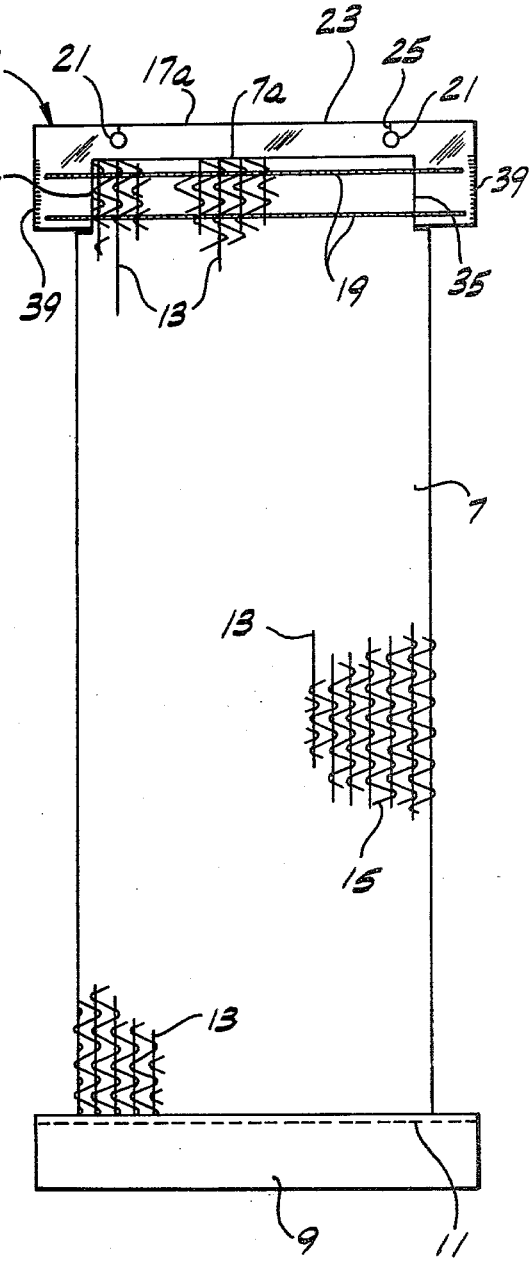
FIG. 2 is a back elevation of the bag.

As illustrated in FIGS. 1 and 2, the tube is formed of knitted net material, and is preferably formed of material knit from strands constituted by narrow ribbons of high-density polyethylene film. The particular knit construction illustrated is a so-called Raschel knit construction, having double-strand wales 13 and zigzagging course yarns 15 between the wales, such as may be knit on a Sacorra knitting machine made by W. Barfuss & Co. of Monchen-Gladbach, West Germany. It will be understood, however, that the tube may be formed of woven open-mesh material (e.g., leno-woven net) instead of knit material. The exact construction of the net material is not critical so far as this invention is concerned.

In accordance with this invention, one of the walls of the bag, herein the wall 7 (which may be referred to as the back wall of the bag), has a flap 17 extending beyond its open mouth edge 7*a* and beyond the mouth edge 5*a* of the other (front) wall 5. This flap comprises a piece of sheet material secured to the wall 7 of the bag and having a portion 17*a* projecting beyond the mouth edge 7*a* of the wall 7 adapted to receive fastening means for holding a plurality of the bags in a stack, with the flap of each bag being adapted to be torn off the fastening means. Further in accordance with this invention, a second piece of sheet material, designated 18, is secured to the other wall 5 of the bag (which may be referred to as its front wall) at the mouth edge of the bag. The projecting portion 17*a* of the flap 17 not only projects beyond the mouth edge 7*a* of the wall 7 but also projects beyond the lateral edge 18*a* of said second piece of material 18 at the mouth of the bag.

The flap 17 is constituted by a strip of sheet material extending across the wall 7 of the bag on the inside thereof and sealed to the wall 7 as indicated at 19. Preferably, the flap comprises a strip of heat-sealable plastic film, such as two mil polyethylene film, secured to the inside of wall 7 of the bag by adhering it thereto by means of stripes of hot melt adhesive indicated at 19 extending lengthwise of the strip (crosswise of the bag). The strip 17 has a pair of holes 21 punched in its projecting portion 17*a*, the holes being spaced transversely of the bag and located adjacent the outer lateral edge 23 of the strip for receiving fastening means, such as pins or the legs of a wicket, for holding a plurality of the bags in a stack, and enabling tearing off the strip (and hence the bag to which the strip is secured) from the means extending through the holes by tearing through the strip from the holes 21 to the outer lateral edge 23 of the strip. To facilitate the tearing, the strip may be suitably weakened as indicated at 25 on lines extending from the holes to its outer edge. As illustrated, the holes are adjacent the outside corners of the flap.

Figure 3:
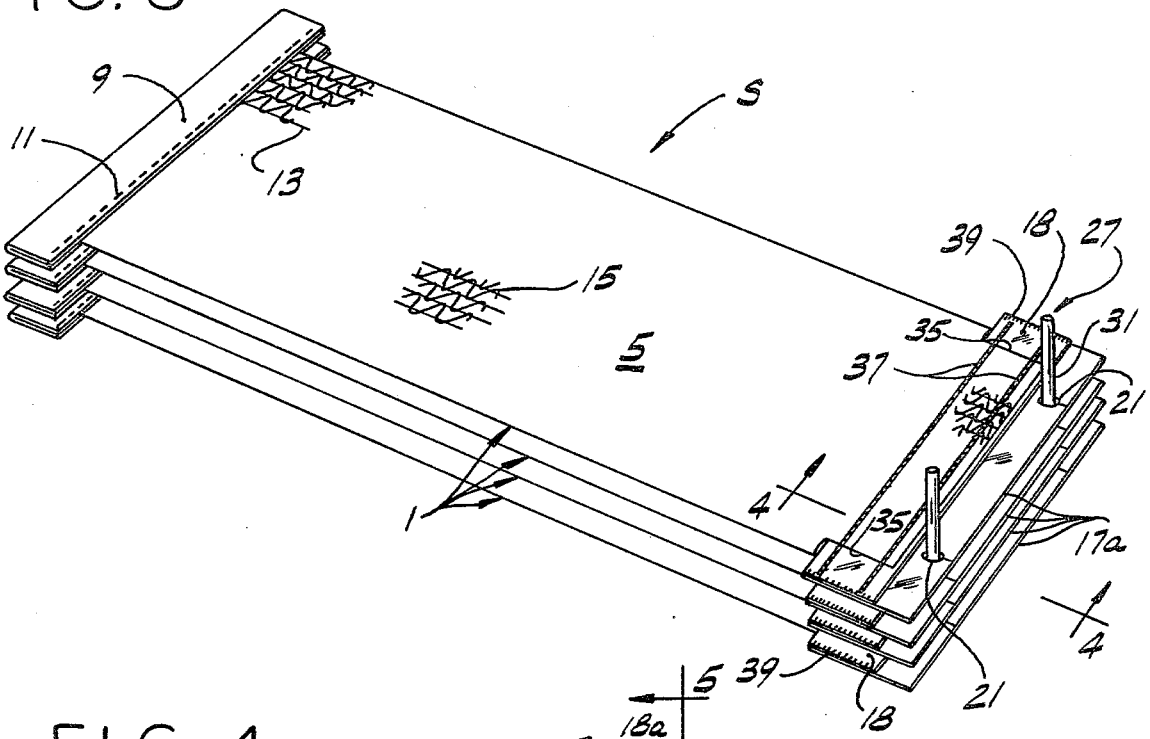
FIG. 3 is a perspective illustrating a wicketed stack of the bags.
Figure 4:
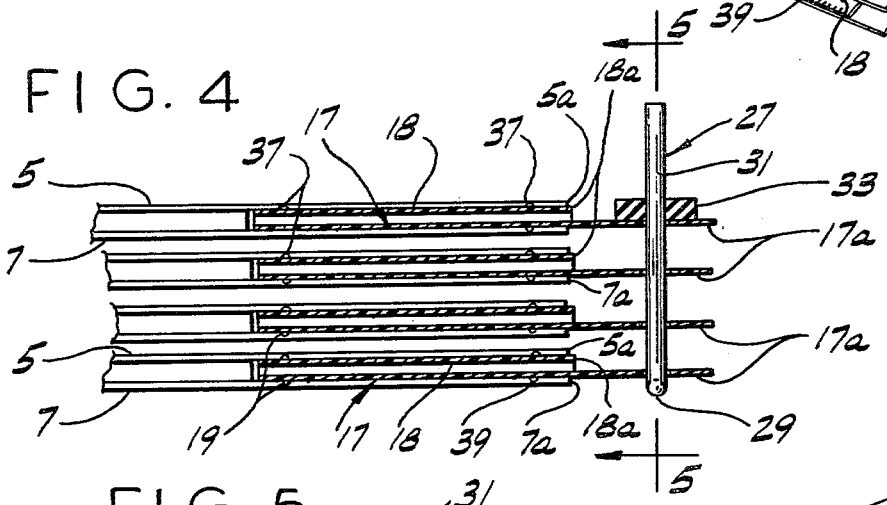
FIG. 4 is a section on line 4—4 of FIG. 3.
Figure 5:
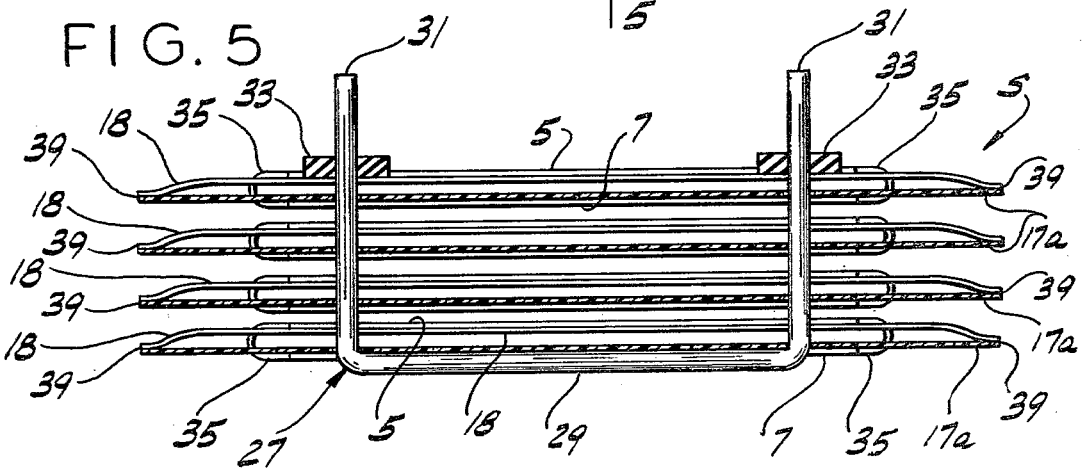
FIG. 5 is a section on line 5—5 of FIG. 4.

FIGS. 3–5 show a stack S of the bags 1 (only four bags being shown to simplify the drawing) in which the bags are stacked one on another with the back wall 7 of each bag against the front wall 5 of the next bag, and with the bag bottoms 9 one on another in the stack and the projecting portions 17*a* of the flap of the bags one on another in the stack with the holes 21 in alignment. The bags, thus stacked, are held together in the stack by fastening means shown in FIGS. 3–5 as comprising a wicket 27 having a cross bar 29 and legs 31, the cross bar 29 extending crosswise relative to the bags under the projecting portion 17*a* of the flap 17 of the lowermost bag of the stack and the legs 31 extending up through the holes 21 in the flap and projecting up above the flap of the uppermost bag. Any suitable means such as rubber washers 33 (see FIGS. 4 and 5; omitted in FIG. 3) may be applied to the legs 31 of the wicket overlying the flap of the uppermost bag to hold the bags on the wicket.

In one mode of use of a packet of bags such as shown in FIGS. 3–5, the stack of bags is transferred from the wicket to a pair of tubular pins (not shown) in a bag filling machine, the pins extending through the holes 21. The stack of bags is thereby held on the pins with each successive bag adapted to be opened at its mouth, separated from the stack for being filled by tearing its flap 17 off the pins, and then closed at its mouth as by means of a wire tie after it has been filled. It is also possible that the bags remain on the wicket when placed in a filling apparatus, in which case they are torn off the wicket.

The tube 3 is cut at its sides as indicated at 35 for a distance D down from its mouth end to separate the walls 5 and 7 of the tube at the sides of the tube for this distance D. In a typical bag wherein the tube 3 is about 23 inches long and 9 inches wide, the distance D is about 3 inches. The strip 17 extends across the inside of the back wall 7 of the bag and projects out beyond the sides of the bag through the cuts 35 for some distance (e.g., about one inch). In the typical bag mentioned, strip 17 may be about 11 inches long and $4\frac{1}{4}$ inches wide, projecting one inch beyond each side of the bag, set in about 3 inches into the bag (to the lower end of the cuts 35), its projecting portion 17*a* thereby being about $1\frac{1}{4}$ inches wide. The stated second piece of material 18 is constituted by a strip of sheet material, preferably a strip of heat-sealable plastic film such as two mil polyethylene film (the same as strip 17) of the same length as the strip 17 and of a width generally corresponding to the distance D. It extends across the inside of the front wall 5 with its lateral edge 18*a* at the mouth of the bag generally flush with the mouth edge 5*a* of the front wall 5, and projects out beyond the sides of the bag through the cuts 35 for the same distance as strip 17. Thus, the strip 18, having a wide corresponding generally to the depth of the cuts 35, is set in about its full width into the bag on the inside of wall 5. The strip 18 is secured to the front wall 5 of the bag on the inside of the front wall by adhering it thereto by means of two stripes of hot melt adhesive indicated at 37 extending lengthwise of the strip 18 (crosswise of the bag). The strips 17 and 18 are heat-sealed together at their ends outward of the sides of the bag as indicated at 39.

Figures 6, 7, 8, 9:
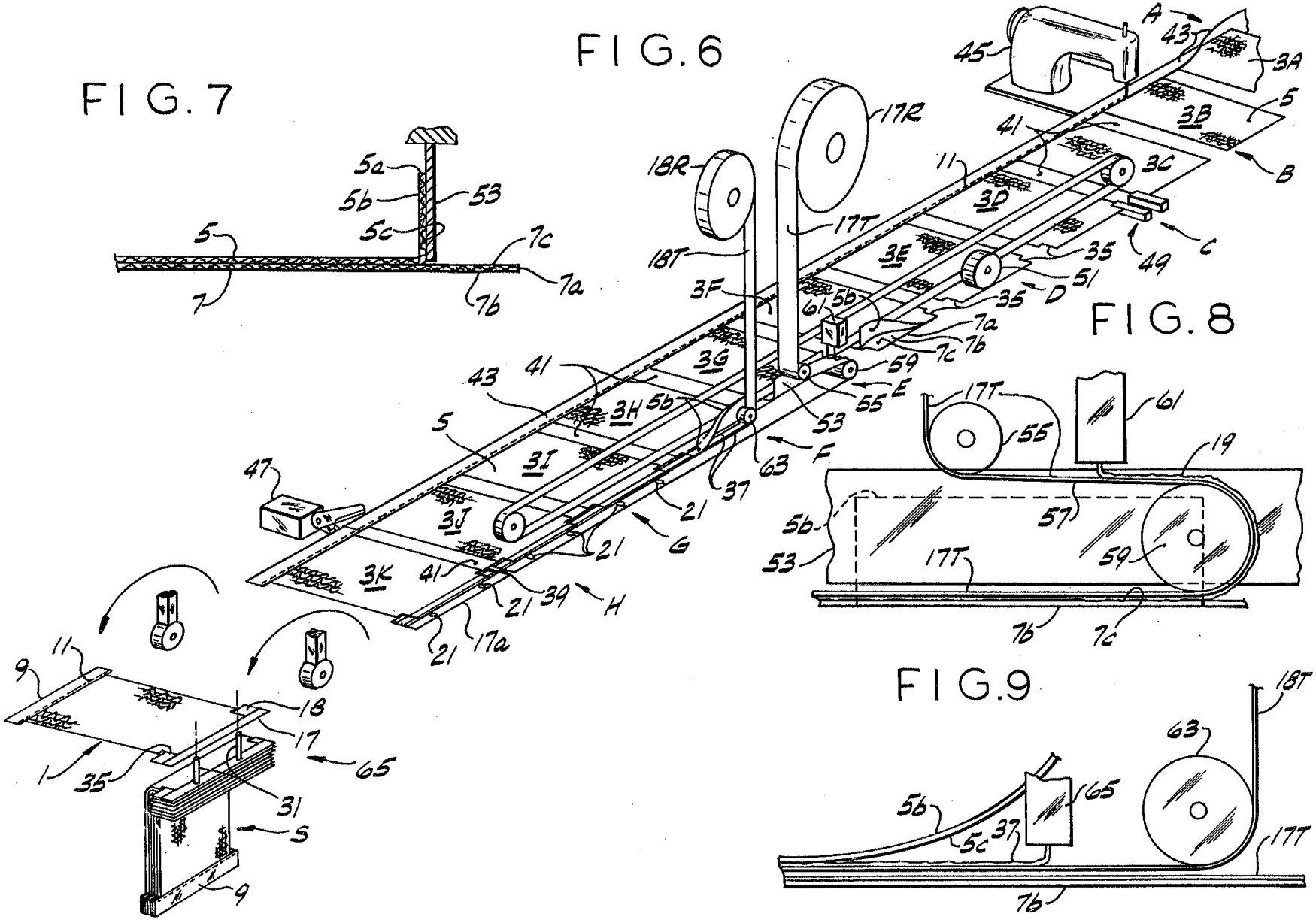
FIG. 6 is a perspective illustrating the method of this invention.
FIG. 7 is a section showing a detail of FIG. 6.
FIGS. 8 and 9 are views showing further details of FIG. 6.

FIG. 6 illustrates a method for providing the net bags (flat tubes 3 of net material) with the flap means of this invention (strips 17, 18), the method involving feeding forward a series of the bags one after another in a predetermined path with the bags lying flat in a horizontal plane extending transversely of said path and spaced longitudinally along said path, with spaces such as indicated at 41 between successive bags, and with the mouth ends of the bags generally aligned. In FIG. 6, bags 3A–3K are shown in the series. As illustrated, the top wall of each bag is the wall 5; the bottom wall is the wall 7.

As the bags are fed forward, a paper tube 43, which is to constitute the bottom closures or "headers" 9 of the bags, is folded around the bottom ends of the bag tubes at zone A and secured thereto by stitching 11 at zone B by means of a sewing machine indicated at 45. The folded paper tape 43 extends continuously of the series of bags, extending from bag to bag across the spaces 41 between successive bags. It is ultimately severed as by means of a clipper 47 between the leading bag 3K of the series and the next bag 3J of the series. Clipper 47 may move forward with the bags for some distance as they travel forward, being activated to cut the tape 43 as it moves forward, then being opened to be clear of the bags and returned to its initial position for the next cycle. The application of the header tape 43 to the bags as they go through the method of this invention for providing the bags with the flap means of this invention is not critical; the bags may be provided with the headers before or after the provision of the flap means. However, it is of some help in holding the bags in series.

As the bags or tubes 3 proceed through zone C (following zones A and B) in their path of travel, they are cut at their sides as indicated at 35 for the distance D inward from their mouth ends thereby to separate the walls 5 and 7 of each bag at the sides of the bag for this distance D in from its mouth end. The cutting may involve a notching of the bag at its sides at its mouth end, and results in walls 5 and 7 having mouth end portions 5*b* and 7*b* which are free of one another at the sides of the bag for the distance D, enabling the mouth end portion 5*b* of wall 5, which is the upper wall of the bag as it is fed forward, to be folded up to expose the inside face 7*c* of the mouth end portion 7*b* of the wall 7, which is the lower wall of the bag. The cutting of the sides of the bags at 35 may be effected by means of a dual cutting instrumentality 49 which moves forward with the bags for some distance as they travel forward, which is closed to notch the leading mouth end corner of one bag and the trailing mouth end corner of the next bag forward as it moves forward, and which is then opened to be clear of the bags and returned to its initial position for the next cycle. As shown in FIG. 6, the cutting instrumentality 49 acts during each cycle of its operation, on its forward stroke, to notch the leading (downstream) mouth end corner of the bag 3C of the series and the trailing (upstream) mouth end corner of the next bag 3D forward in the series. Thus, each bag proceeding on from zone C has the cuts or notches 35 at both its mouth end corners.

As each bag proceeds forward from zone C through a zone D, the free mouth end portion 5*b* of its upper wall 5 is folded up away from the mouth end portion 7*b* of the lower wall 7 to expose the inside face 7*c* of said mouth end portion 7*b* and to provide for entry between the mouth end portions 5*b* and 7*b* of a pair of tapes 17T and 18T to provide the strips 17 and 18 for the bags. This folding up of the mouth end portions 5*b* of the bags may be effected as by means of a roller 51 having a pressure-sensitive adhesive facing for picking up portion 5*b* and directing it behind a suitable guide 53 (see FIG. 7). The roller 51 may move forward with each bag for some distance as the bag travels forward, and then return to an initial position for the next cycle.

The tape 17T, which is of heat-sealable material such as polyethylene, for example, is fed into engagement with and secured to the inside face 7*c* of the mouth end portion 7*b* of the wall 7 of each bag in zone E. For this purpose the tape 17T is fed down from a supply wall 17R of the tape, under and rearward around a guide roll 55 so as to have a rearwardly traveling reach 57, and over and forward around a guide roll 59 which functions to press the tape down on the inside face 7*c* of mouth end portion 7*a* of wall 7. As the tape 17T travels through the reach 57 from roll 55 to roll 59, hot melt adhesive is applied to the upper face thereof by means such as indicated at 61 in two stripes 19 for adhering it to the inside face 7*c* of the mouth end portion 7*b*. The tape 17T is fed in such position laterally with respect to the path of travel of the bags as to overlap and thereby project beyond the mouth edge 7*a* of portion 7*b* of wall 7. For the typical bag mentioned, the tape 17T would be 4¼ inches wide and laterally located so that its inner lateral edge is about 3 inches in from the mouth edge 7*a* of wall 7 and its outer lateral edge is about 1¼ inches outward of edge 7*a*, thereby to project about 1¼ inches from edge 7*a* and provide a 1¼ inch flap 17*a*.

The tape 18T, also of heat-sealable material such as polyethylene, for example, is fed down from a supply roll 18R on the outside of the folded-up mouth end portions 5*b* of the bags and under and forward around a guide roll 63 located downstream from guide roll 59 in zone F. Immediately following (downstream from) zone F, the folded-up mouth end portion 5*b* of each bag is folded back down to its original flatwise position above mouth end portion 7*b*. Tape 18T travels forward from roll 63 underneath the folded down mouth end portions 5*b* of the bags. Hot melt adhesive is applied to the exposed upper face of the tape 18T in its reach which extends from roll 63 to the folded-down mouth end portion 5*b* of the bag downstream from roll 63 by means such as indicated at 65 in FIG. 9 in two stripes 37 for adhering it to the inside face 5*c* of mouth end portion 5*b*. The tape 18T is fed in such position laterally with respect to the path of travel of the bags that its outer lateral edge is generally flush with the mouth edge 5*a* of mouth end portion 5*b* of the bags.

With the tapes 17T and 18T thus adhered by the stripes 19 and 37 of hot melt adhesive to the mouth end portions 7*b* and 5*b* of the bags, the bags proceed to travel through a zone G where the holes 21 (also the lines of weakness 25) are punched in the projecting portion 17*a* of the tape 17T. The punching of the holes may be effected by a suitable punch which moves forward with the bags for some distance as they travel forward, being activated to punch the holes as it travels forward in unison with the bags, then being opened and returned to its initial position for the next cycle.

The bags then proceed through zone H, where the tapes 17T and 18T are severed and heat-sealed together at 39 between the leading bag 3K of the series and the next bag 3J, thereby to separate the bag at 3K from the next bag at 3J. As indicated in FIG. 6, the severing may be on a single line in the space 41 between bags, thus leaving portions of the tapes extending beyond the sides of the bag as appears in FIGS. 1 and 2. It could be such as to remove substantially all or part of the portions of the tapes between bags. The severing and sealing may be effected by means of a heated severing and sealing instrumentality which moves forward in unison with the bags for some distance as they travel forward, closes on the tapes as it moves forward to effect the severing and sealing, then opens and returns rearward to its initial position for the next cycle.

Finally, as each bag at 3K is separated from the next bag at 3J, it is wicketed by means of conventional wicketing apparatus indicated at 65 in FIG. 7 to form a wicketed packet such as the wicketed stack of FIGS. 3–5.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A bag made of net material having opposed walls, closed at its bottom and open at its mouth end, each wall having a mouth edge, one of the walls having a flap extending beyond its mouth edge and beyond the mouth edge of the other wall, said flap comprising a piece of sheet material secured to said one wall of the bag and having a portion projecting beyond the mouth edge of said one wall, said projecting portion having a pair of holes spaced transversely of the bag for receiving fastening means, such as the legs of a wicket, for holding a plurality of the bags in a stack, the flap of each bag being adapted to be torn off said fastening means, and a second piece of sheet material secured to the other wall of the bag at its mouth edge, the projecting portion of said flap also projecting beyond the edge of said second piece of sheet material at the mouth of the bag.

2. A bag made of net material having opposed walls, closed at its bottom and open at its mouth end, each wall having a mouth edge, one of the walls having a flap extending beyond its mouth edge and beyond the mouth edge of the other wall, said flap comprising a piece of sheet material secured to said one wall of the bag and having a portion projecting beyond the mouth edge of said one wall, said projecting portion being adapted to receive means for holding a plurality of the bags in stacked assembly, the flap of each bag being adapted to be torn off said means, and a second piece of sheet material secured to the other wall of the bag at its mouth edge, the projecting portion of said flap also projecting beyond the edge of said second piece of sheet material at the mouth of the bag; said flap being constituted by a first strip of sheet material extending across said one wall of the bag sealed to said one wall, said second piece of sheet material being constituted by a second strip of sheet material extending across said other wall of the bag sealed to said other wall, the first strip being of such width and so located relative to the second strip as to have said portion projecting beyond the lateral edge of the second strip at the mouth of the bag, each of said strips extending outwardly beyond the sides of the bag with the ends of the strips spaced from the sides of the bag.

3. A bag as set forth in claim 2 wherein said strips are sealed together at their ends outward of the sides of the bag.

4. A bag as set forth in claim 2 wherein the first strip has a pair of holes in the portion thereof outward of the said lateral edge of the second strip, said holes being spaced transversely of the bag for receiving fastening means, such as the legs of a wicket, for holding a plurality of the bags in a stack.

5. A bag as set forth in claim 4 wherein the holes are adjacent outer lateral edge of the first strip for tearing off the first strip from means extending through the holes by tearing through the first strip from the holes out to the outer lateral edge of the first strip.

6. A bag as set forth in claim 5 wherein the first strip is weakened for tearing on lines from the holes to its outer edge.

7. A bag as set forth in claim 5 wherein the strips are of heat-sealable material and are heat-sealed together at their ends outward of the sides of the bag.

8. A bag made of net material having opposed walls, closed at its bottom and open at its mouth end, each wall having a mouth edge, one of the walls having a flap extending beyond its mouth edge and beyond the mouth edge of the other wall, said flap comprising a piece of sheet material secured to said one wall of the bag and having a portion projecting beyond the mouth edge of said one wall, said projecting portion being adapted to receive means for holding a plurality of the bags in stacked assembly, the flap of each bag being adapted to be torn off said means, and a second piece of sheet material secured to the other wall of the bag at its mouth edge, the projecting portion of said flap also projecting beyond the edge of said second piece of sheet material at the mouth of the bag, said flap being constituted by a first strip of sheet material extending across said one wall of the bag sealed to said one wall, and said second piece of sheet material being constituted by a second strip of sheet material extending across said other wall of the bag sealed to said other wall, the first strip being of such width and so located relative to the second strip as to have said portion projecting beyond the lateral edge of the second strip at the mouth of the bag, said strips extending beyond the sides of the bag, said bag comprising a flat tube of the net material, the tube being cut at its sides for a distance from its mouth end to separate the walls of the tube at the sides thereof for said distance, one of said strips extending across the inside of the wall to which it is secured and out through said cuts.

9. A bag as set forth in claim 8 wherein the other strip extends across the inside of the other wall and out through said cuts.

10. A bag as set forth in claim 9 wherein said strips are sealed together at their ends outward of the sides of the bag.

11. A bag as set forth in claim 8 wherein the first strip has a pair of holes in the portion thereof outward of the said lateral edge of the second strip, said holes being spaced transversely of the bag for receiving fastening means, such as the legs of a wicket, for holding a plurality of the bags in a stack.

12. A bag as set forth in claim 11 wherein the holes are adjacent the outer lateral edge of the first strip for tearing off the first strip from means extending through the holes by tearing through the first strip from the holes out to the outer lateral edge of the first strip.

13. A bag as set forth in claim 12 wherein the first strip is weakened for tearing on lines from the holes to its outer edge.

14. A bag as set forth in claim 12 wherein the strips are of heat-sealable material and are heat-sealed together at their ends outward of the sides of the bag.

15. A stack of bags each of which is a bag of net material having front and back walls, closed at its bottom and open at its mouth end, each wall having a mouth edge, the back wall having a flap extending beyond the mouth edge of the front wall, said flap comprising a piece of sheet material secured to the back wall and having a portion projecting beyond the mouth edge of the front wall, and a second piece of sheet material secured to the front wall of the bag at its mouth edge, the projecting portion of said flap also projecting beyond the edge of said second piece of sheet material at the mouth of the bag, the bags being stacked with the back wall of each bag against the front wall of the next bag, and means extending through the said projecting portions of the said flaps holding the bags together in the stack, the flap of each bag being adapted to be torn off said means.

16. A stack of bags as set forth in claim 16 wherein, as to each bag, the flap is constituted by a first strip of sheet material extending across the back wall of the bag sealed to said back wall, and said second piece of sheet material is constituted by a second strip of sheet material extending across the front wall of the bag sealed to said front wall, the first strip being of such width and so located relative to the second strip as to have said portion projecting beyond the lateral edge of the second strip at the mouth of the bag, each of said strips extending outwardly beyond the sides of the bag with the ends of the strips spaced from the sides of the bag.

17. A stack of bags as set forth in claim 16 wherein, as to each bag, said strips are sealed together at their ends outward of the sides of the bag.

18. A stack of bags as set forth in claim 16 wherein, as to each bag, the first strip has a pair of holes in the portion thereof outward of the said lateral edge of the second strip, said holes being spaced transversely of the bag for receiving fastening means, such as the legs of a wicket, for holding a plurality of bags in a stack.

19. A stack of bags as set forth in claim 18 wherein, as to each bag, the holes are adjacent the outer lateral edge of the first strip for tearing off the first strip from means extending through the holes by tearing through the first strip from the holes out to the outer lateral edge of the first strip.

20. A stack of bags as set forth in claim 19 wherein, as to each bag, the first strip is weakened for tearing on lines from the holes to its outer edge.

21. A stack of bags as set forth in claim 19 wherein, as to each bag, the strips are of heat-sealable material and are heat-sealed together at their ends outward of the sides of the bag.

22. A stack of bags each of which is a bag of net material having front and back walls, closed at its bottom and open at its mouth end, each wall having a mouth edge, the back wall having a flap extending beyond the mouth edge of the front wall, said flap comprising a piece of sheet material secured to the back wall and having a portion projecting beyond the mouth edge of the front wall, and a second piece of sheet material secured to the front wall of the bag at its mouth edge, the projecting portion of said flap also projecting beyond the edge of said second piece of sheet material at the mouth of the bag, the bags being stacked with the back wall of each bag against the front wall of the next bag, and means extending through the said projecting portions of the said flaps holding the bags together in the stack, the flap of each bag being adapted to be torn off said means, said flap of each bag being constituted by a first strip of sheet material extending across the back wall of the bag sealed to said back wall, and said second piece of sheet material of each bag being constituted by a second strip of sheet material extending across the front wall of the bag sealed to said front wall, the first strip being of such width and so located relative to the second strip as to have said portion projecting beyond the lateral edge of the second strip at the mouth of the bag, said strips extending beyond the sides of the bag, each bag comprising a flat tube of the net material, the tube being cut at its sides for a distance from its mouth end to separate the walls of the tube at the sides thereof for said distance, one of said strips extending across the inside of the wall to which it is secured and out through said cuts.

23. A stack of bags as set forth in claim 22 wherein, as to each bag, the other strip extends across the inside of the other wall and out through said cuts.

24. A stack of bags as set forth in claim 23 wherein, as to each bag, said strips are sealed together at their ends outward of the sides of the bag.

25. A stack of bags as set forth in claim 23 wherein, as to each bag, the first strip has a pair of holes in the portion thereof outward of the said lateral edge of the second strip, said holes being spaced transversely of the bag for receiving fastening means, such as the legs of a wicket, for holding a plurality of the bags in a stack.

26. A stack of bags as set forth in claim 25 wherein, as to each bag, the holes are adjacent the outer lateral edge of the first strip for tearing off the first strip from means extending through the holes by tearing through the first strip from the holes out to the outer lateral edge of the first strip.

27. A stack of bags as set forth in claim 26 wherein, as to each bag, the first strip is weakened for tearing on lines from the holes to its outer edge.

28. A stack of bags as set forth in claim 26 wherein, as to each bag, the strips are of heat-sealable material, extend beyond the sides of the bag, and are heat-sealed together at their ends outward of the sides of the bag.

* * * * *

UNITED STATES PATENT AND TRADEMARK OFFICE

CERTIFICATE OF CORRECTION

PATENT NO. : 4,207,983

DATED : June 17, 1980

INVENTOR(S) : Eugene H. Wolske

It is certified that error appears in the above-identified patent and that said Letters Patent are hereby corrected as shown below:

Column 4, line 26, "wide" should read --width--; line 47, "tube" should read --tape--. Column 7, line 43, "outer" should read --the outer--. Column 8, line 57, "claim 16" should read --claim 15--.

Signed and Sealed this

*Thirtieth* Day of *December 1980*

[SEAL]

*Attest:*

SIDNEY A. DIAMOND

*Attesting Officer*

*Commissioner of Patents and Trademarks*